US006006056A

United States Patent [19]

Hagiwara et al.

[11] Patent Number: 6,006,056

[45] **Date of Patent: *Dec. 21, 1999**

[54] PHOTORECEPTOR UNIT WITH BRAKING MEMBER

[75] Inventors: Toshihiro Hagiwara, Toyokawa; Hirotsune Yaji, Aichi-ken, both of Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/967,966

[22] Filed: Nov. 13, 1997

[30] Foreign Application Priority Data

Nov. 15, 1996 [JP] Japan ..... H8-305302

[51] Int. Cl.[6] ..... G03G 15/00

[52] U.S. Cl. ..... 399/159; 399/167

[58] Field of Search ..... 399/116, 117, 399/159, 167

[56] References Cited

U.S. PATENT DOCUMENTS 5,019,861 5/1991 Surti ..... 399/111

5,722,013 2/1998 Nagase et al. ..... 399/112

FOREIGN PATENT DOCUMENTS 60-84547 5/1985 Japan .

62-32246 2/1987 Japan .

63-34327 2/1988 Japan .

08194354 7/1996 Japan .

*Primary Examiner*—Joan Pendegrass

*Attorney, Agent, or Firm*—McDermott, Will & Emery

[57] ABSTRACT

A photoreceptor unit capable of stabilizing rotation of a photoreceptor drum housed in a housing of the photoreceptor unit without causing a displacement of the photoreceptor drum. The photoreceptor unit is provided with a braking member as a mechanism for stabilizing the rotation of the photoreceptor drum, the braking member being arranged between a part of the photoreceptor drum and a part of the housing or a support shaft for rotatably supporting the photoreceptor drum so as to effect a load in a radial direction throughout the entire circumference of the rotation of the photoreceptor drum.

8 Claims, 6 Drawing Sheets

PHOTORECEPTOR UNIT WITH BRAKING MEMBER

BACKGROUND OF THE INVENTION

1. Field of the Invention

The present invention relates to a photoreceptor unit in which a photoreceptor drum is housed in a housing.

2. Description of the Related Art

Generally in the field of image forming apparatuses such as electrophotographic copying machines and laser printers, there has been proposed a variety of photoreceptor units in which a photoreceptor drum and its accessory elements are housed in a housing.

This kind of photoreceptor unit requires a mechanism for stabilizing the rotation of the photoreceptor drum. Since the unit is dimensionally increased when a flywheel is adopted as this mechanism, compact braking members have been widely used.

For example, there has been a known photoreceptor unit as shown in FIG. 9, where a braking member 6 is placed between an end surface of a flange 2 of a photoreceptor drum 1 and an inner surface of a housing 5 in a state in which it is compressed in the axial direction of the photoreceptor drum. However, since a load due to the braking member 6 is exerted in the axial direction of the photoreceptor drum 1 in this photoreceptor unit, a side segment 5*a* of the housing 5 is deformed in the direction of arrow "d", and this has led to the problem that a support shaft 3 receives a moment in the direction of arrow "e", consequently displacing the position of the photoreceptor drum 1.

In an attempt at solving the aforementioned problem, there has also been a photoreceptor unit as shown in FIG. 10, where the support shaft 3 is formed of one member that penetrates the photoreceptor drum 1 and is placed between the side segments 5*a* and 5*a* of the housing 5. However, when the support shaft 3 is formed of one member that penetrates the photoreceptor drum 1, the weight of the entire unit becomes heavy and a cost increase results.

There has further been a known photoreceptor unit as shown in FIG. 11, where a braking member 7 is arranged between an outer peripheral surface of a flange 2 of a photoreceptor drum 1 and a housing opening inner peripheral surface 5*b* over approximately a half of the circumference of the photoreceptor drum. However, this unit also has the problem that a load due to the braking member 7 is effected in the direction of arrow "f", causing a displacement of the photoreceptor drum 1.

SUMMARY OF THE INVENTION

It is an object of the present invention to provide an improved photoreceptor unit which solves the aforementioned problems.

A further object of the present invention is to provide a lightweight inexpensive photoreceptor unit capable of stabilizing the rotation of the photoreceptor drum without causing a displacement of the photoreceptor drum.

The above objects can be achieved by providing a photoreceptor unit comprising:

a photoreceptor drum;

a housing for housing therein the photoreceptor drum;

a support shaft which is fixed to the housing and rotatably supports the photoreceptor drum; and a braking member provided between a part of said photoreceptor drum and a part of said housing or said support shaft, the braking member effecting a load in the radial direction throughout the entire circumference of rotation of said photoreceptor drum.

In the aforementioned photoreceptor unit, said braking member is preferably compressed in the radial direction throughout the entire circumference of rotation of said photoreceptor drum.

Furthermore, in the aforementioned photoreceptor unit, it is acceptable to constitute said photoreceptor drum by a hollow cylindrical base body and first and second flanges provided on both sides of the base body, provide at least one of the first and second flanges with a cylindrical recess portion recessed in the axial direction of the photoreceptor drum throughout the entire circumference of said support shaft, and constitute said braking member by a ring-shaped member which is arranged in said recess portion as fixed to either the inner peripheral surface of said recess portion or said support shaft and pressed against the other.

Furthermore, in the aforementioned photoreceptor unit, it is acceptable to provide said photoreceptor drum with a hollow cylindrical base body and constitute said braking member by a disk-shaped member which is arranged inside said base body as fixed to either the inner peripheral surface of said base body or said support shaft and pressed against the other.

Additionally, in the aforementioned photoreceptor unit, it is acceptable to make said housing include a cylindrical portion which surrounds the outer peripheral surface of said photoreceptor drum throughout its entire circumference of rotation and constitute said braking member by a ring-shaped member which is provided between the outer peripheral surface of said photoreceptor drum and the inner peripheral surface of said cylindrical portion as fixed to either the outer peripheral surface of said photoreceptor drum or the inner peripheral surface of said cylindrical portion and pressed against the other.

Furthermore, in the aforementioned photoreceptor unit, it is acceptable to constitute said photoreceptor drum by a hollow cylindrical base body and first and second flanges provided on both sides of the base body, constitute said support shaft by a first support shaft for said first flange and a second support shaft for said second flange, and,separate the first support shaft and the second support shaft from each other.

As a material for said braking member, for example, nitrile rubber is preferable.

According to the photoreceptor unit of the present invention, the aforementioned braking member effects its load in the radial direction throughout the entire circumference of rotation of the photoreceptor drum, and therefore, it does not apply any biased load to the photoreceptor drum. Furthermore, the load is effected only in the radial direction, not in the axial direction, and therefore, the housing is not expanded in the axial direction.

That is, according to the present invention, neither the axial load nor the radially biased load is exerted on the photoreceptor drum and the housing, and therefore, the possible occurrence of the displacement of the photoreceptor drum can be prevented, allowing a stabilized rotation to be ensured. Furthermore, the construction in which the support shaft is divided into two shafts can be adopted without intentionally taking any measure for the reinforcement of the housing, so that the weight reduction of the whole unit can be achieved. It is a matter of course that no trouble occurs even when one support shaft which penetrates the photoreceptor drum is adopted.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE PREFERRED EMBODIMENTS

Preferred embodiments of the photoreceptor unit of the present invention will be described below with reference to the accompanying drawings.

Figure 1:
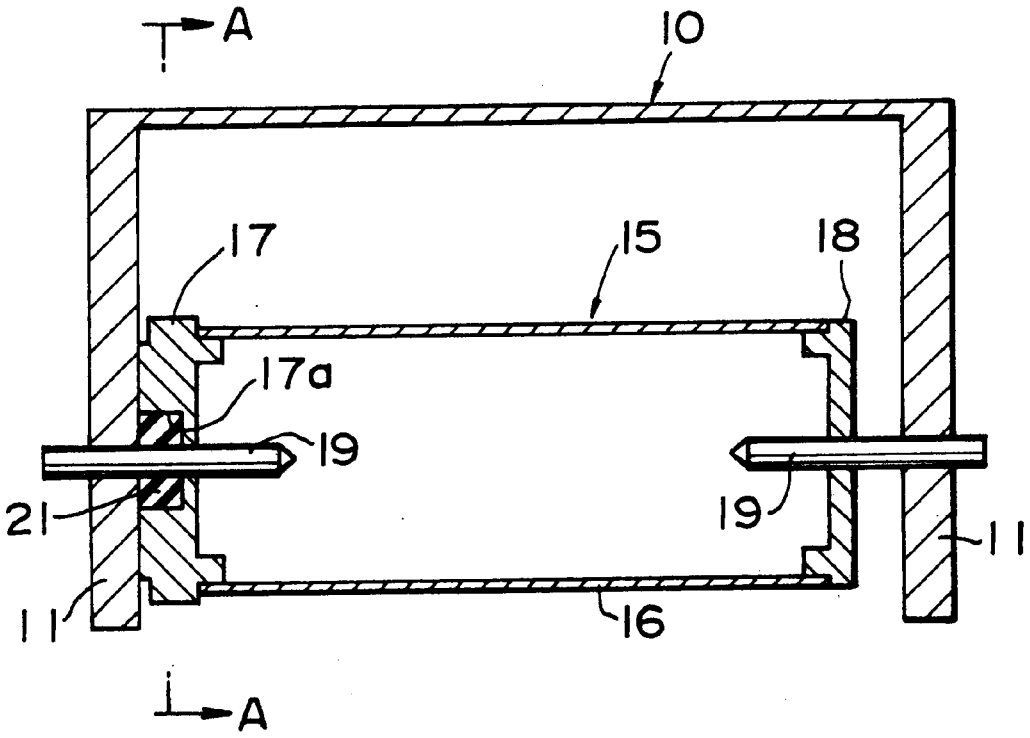
FIG. 1 is a sectional view showing the construction of a photoreceptor unit according to a first embodiment of the present invention.
Figure 2:
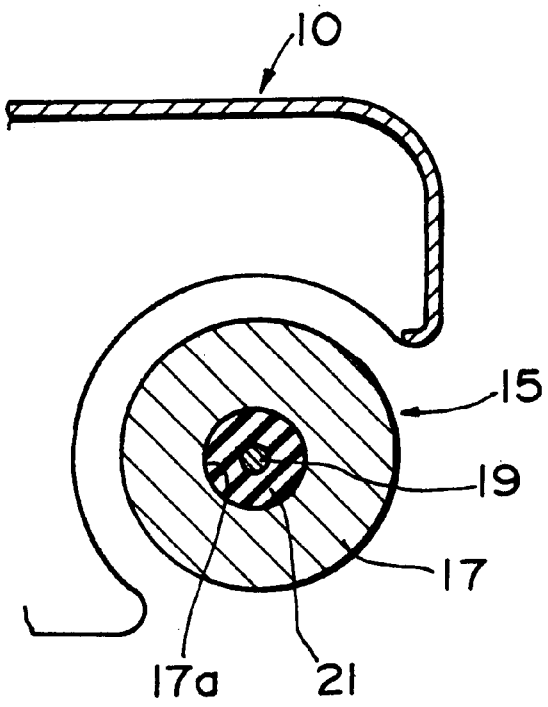
FIG. 2 is a sectional view taken along the line A—A of the photoreceptor unit shown in FIG. 1.

(First Embodiment, see FIGS. 1 and 2)

The photoreceptor unit of the present embodiment is constructed of a housing 10, a photoreceptor drum 15, support shafts 19 and 19 and a braking member 21. The photoreceptor drum 15 is provided by forming a photosensitive layer on the outer peripheral surface of a cylindrical conductive base body 16 made of aluminum and mounting flanges 17 and 18 on both side portions of the base body 16. The support shafts 19 and 19 are fixed to both side segments 11 and 11 of the housing 10, and the flanges 17 and 18 are rotatably mounted around the support shafts 19 and 19. This photoreceptor drum 15 is rotatively driven at a constant speed by a motor (not shown) provided outside the unit via a gear (not shown). Further, accessory elements such as a toner cleaner are housed in the housing 10, however, they are not shown in the figures.

The braking member 21 has a ringlike shape and is mounted in a recess portion 17*a* of a flange 17. The braking member 21 has its inner peripheral surface press-fit on the support shaft 19 and has its outer peripheral surface press-fit on the recess portion 17*a*. This braking member 21 is stuck to the support shaft 19 or the flange 17 by its inner peripheral L-: surface or outer peripheral surface. That is, the braking member 21 is mounted in the recess portion 17*a* in a state in which it is compressed throughout the entire circumference in the radial direction of the photoreceptor drum 15 so as to effect a load between the photoreceptor drum 15 and the support shaft 19. This load is effected in the radial direction throughout the entire circumference of rotation of the photoreceptor drum 15, and it is not effected in the direction toward the axial center and not biasedly effected in the radial direction. Therefore, no displacement of the photoreceptor drum 15 occurs, and its rotation is stabilized.

The support shafts 19 and 19 are made of a material of POM (polyacetals), the braking member 21 is made of a material of NBR (nitrile rubber), and the flange 17 is made of a material of PO [PTFE-15%], i.e., a material formed by incorporating 15% of polytetrafluoroethylene into polycarbonate. However, a variety of materials other than those can be used. For the braking member 21, it is appropriate to select a material which can obtain a required frictional force and has an excellent abrasion resistance, a deformation resistance and sliding smoothness.

Figure 3:
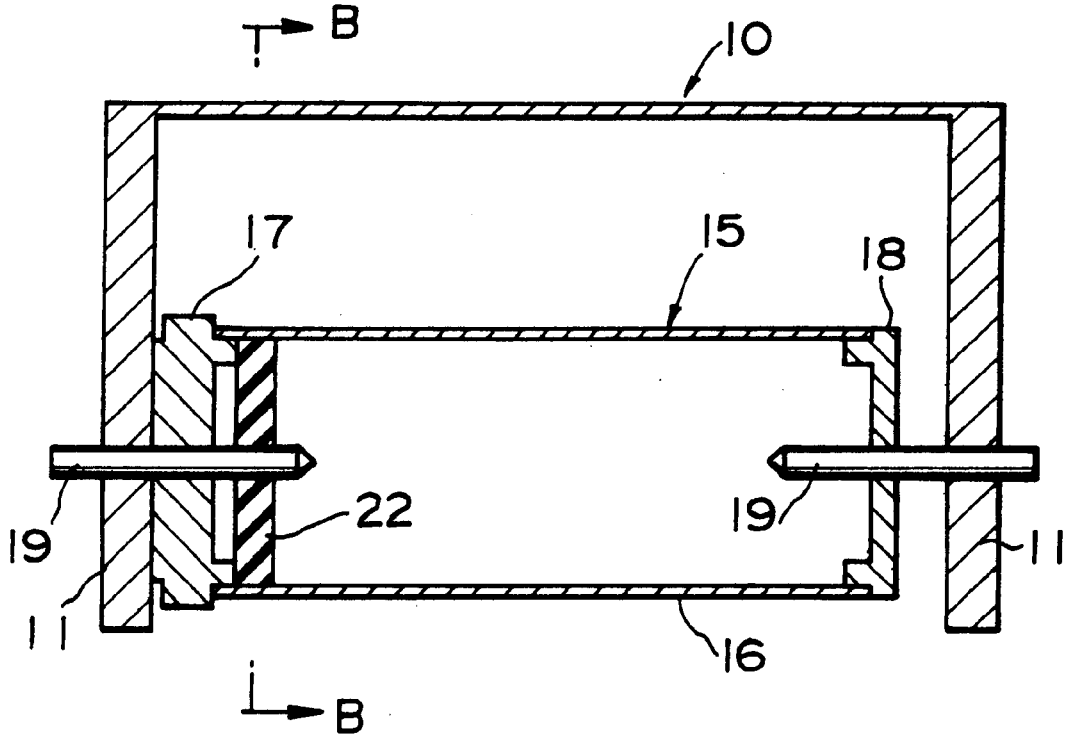
FIG. 3 is a sectional view showing the construction of a photoreceptor unit according to a second embodiment of the present invention.
Figure 4:
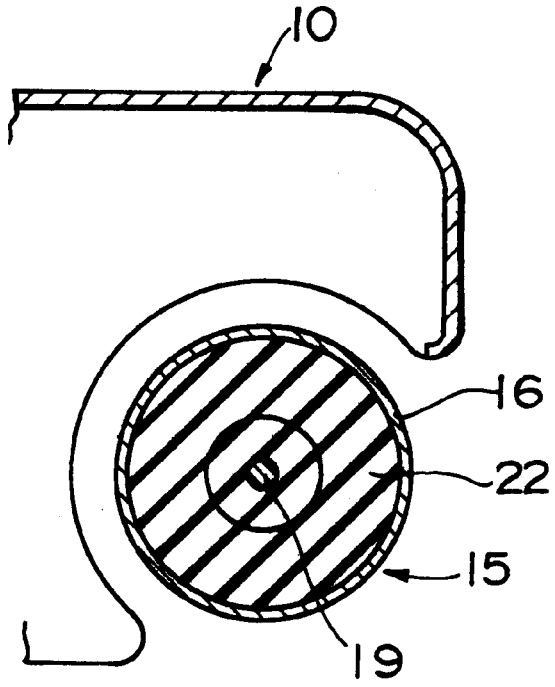
FIG. 4 is a sectional view taken along the line B—B of the photoreceptor unit shown in FIG. 3.

(Second Embodiment, see FIGS. 3 and 4)

According to the photoreceptor unit of the present embodiment, a disk-shaped braking member 22 is mounted between the support shaft 19 and the base body 16 of the photoreceptor drum 15. The other construction is similar to that of the first embodiment shown in FIGS. 1 and 2. The braking member 22 has its inner peripheral surface press-fit on the support shaft 19 and has its outer peripheral surface press-fit on the inner peripheral surface of the base body 16. The braking member 22 is stuck to the support shaft 19 or the base body 16 by its inner peripheral surface or outer peripheral surface. This braking member 22 is compressed throughout the entire circumference in the radial direction of the photoreceptor drum 15 so as to effect a load between the photoreceptor drum 15 and the support shaft 19. The effect of the load is similar to that of the aforementioned first embodiment.

Figure 5:
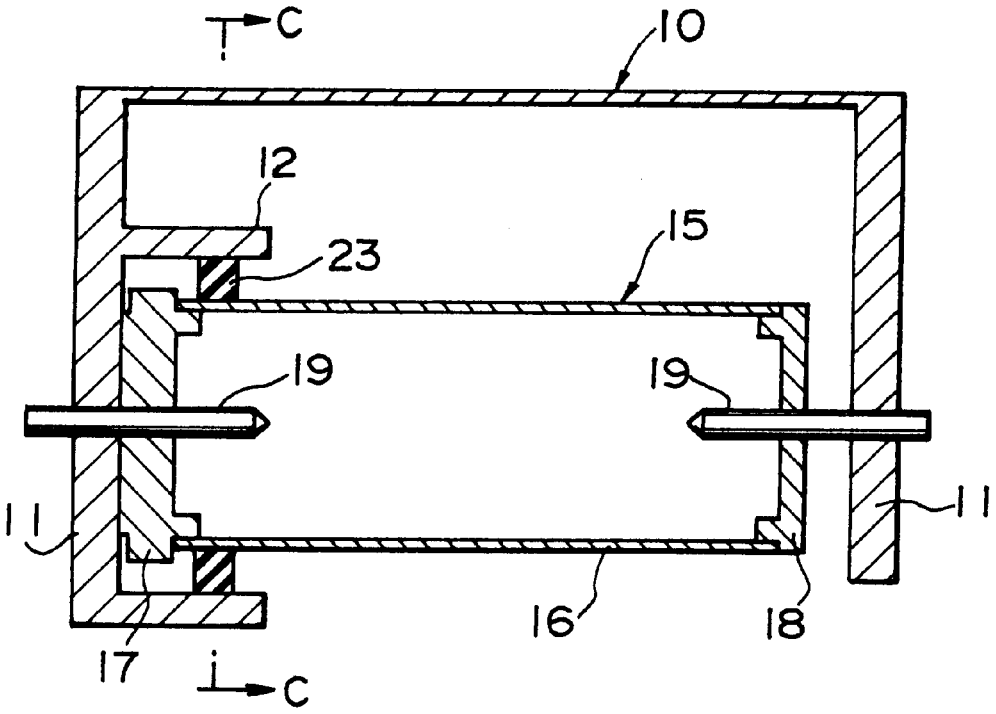
FIG. 5 is a sectional view showing the construction of a photoreceptor unit according to a third embodiment of the present invention.
Figure 6:
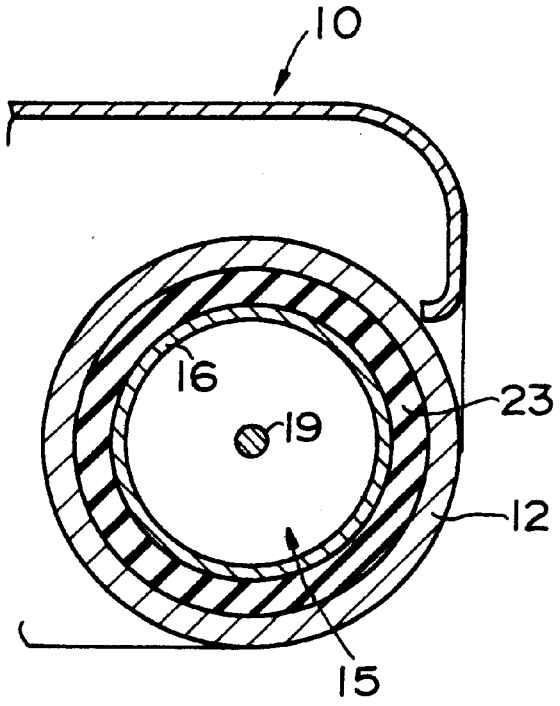
FIG. 6 is a sectional view taken along the line C—C of the photoreceptor unit shown in FIG. 5.

(Third Embodiment, see FIGS. 5 and 6)

According to the photoreceptor unit of the present embodiment, a ring-shaped braking member 23 is mounted between the base body 16 of the photoreceptor drum 15 and a cylindrical portion 12 of the housing 10. The housing 10 is made of a resin material, and the cylindrical portion 12 is integrated with the housing 10. The other construction is similar to that of the aforementioned first embodiment. The braking member 23 has its inner peripheral surface press-fit on the outer peripheral surface of the base body 16 and has its outer peripheral surface press-fit on the inner peripheral surface of the cylindrical portion 12. The braking member 23 is stuck to the base body 16 or the cylindrical portion 12 by its inner peripheral surface or outer peripheral surface. This i braking member 23 is compressed throughout the entire circumference in the radial direction of the photoreceptor drum 15 so as to effect a load between the photoreceptor drum 15 and the cylindrical portion 12. The effect of the load is similar to that of the aforementioned first embodiment.

Figure 7:
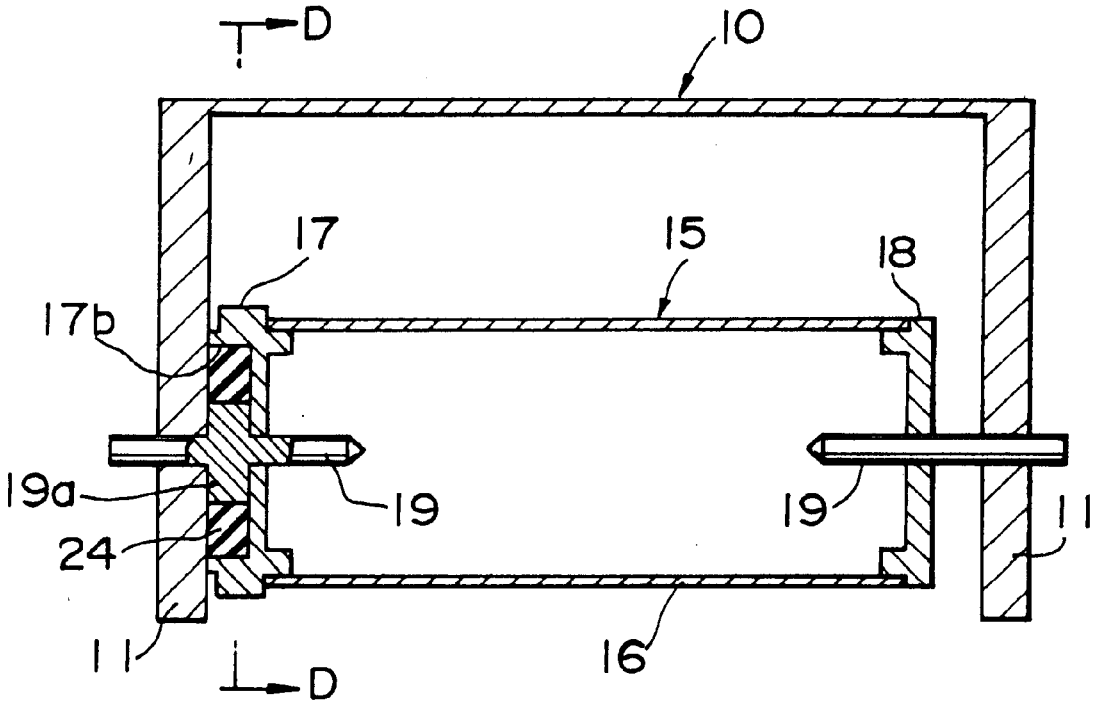
FIG. 7 is a sectional view showing the construction of a photoreceptor unit according to a fourth embodiment of the present invention.
Figure 8:
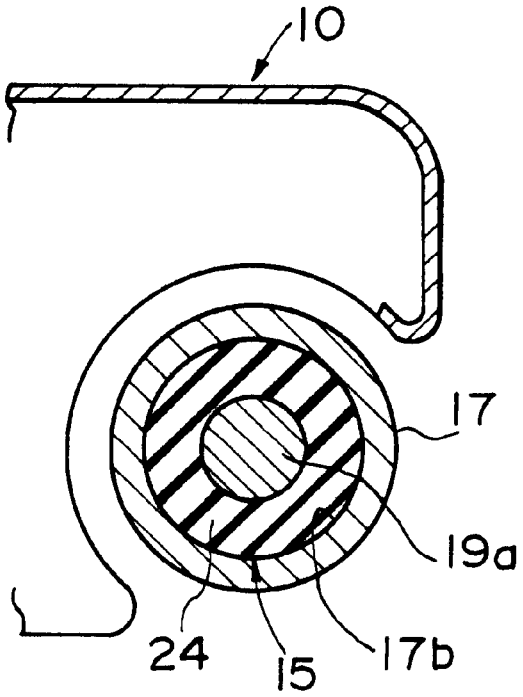
FIG. 8 is a sectional view taken along the line D—D of the photoreceptor unit shown in FIG. 7.
Figure 9:
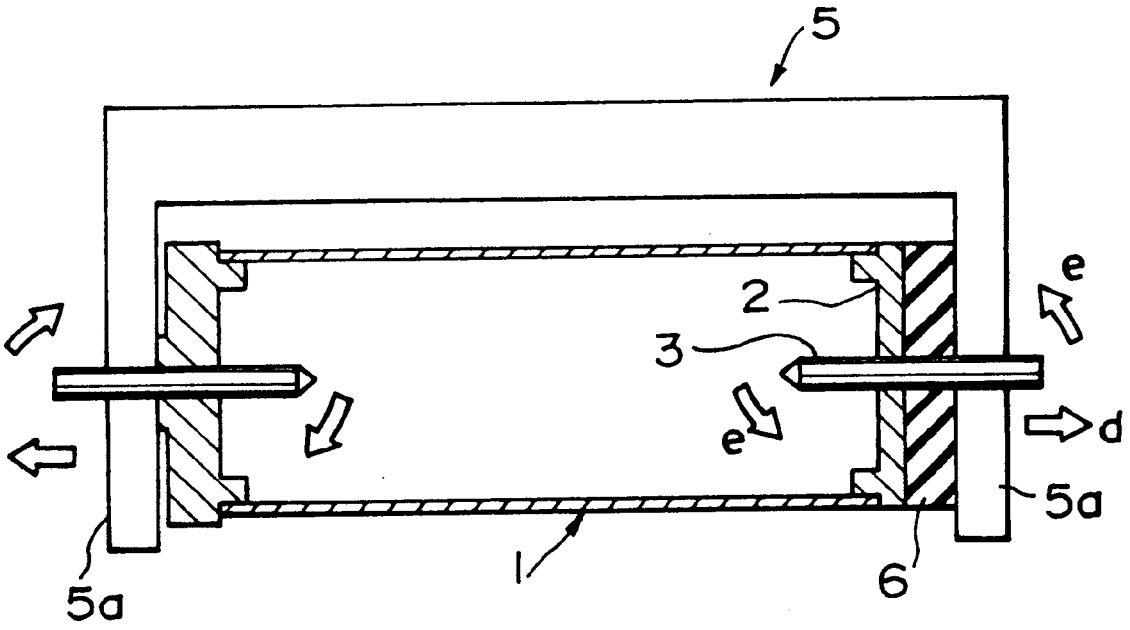
Fig.9 PRIOR ART
FIG. 9 is a sectional view showing an example of a prior art photoreceptor unit.
Figure 10:
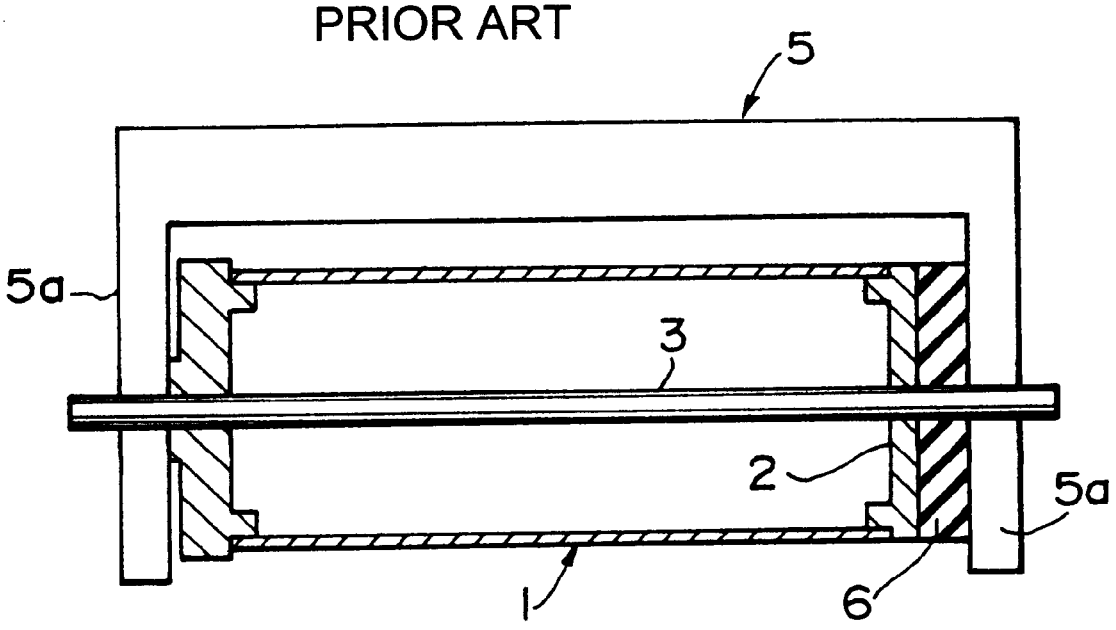
Fig.10 PRIOR ART
FIG. 10 is a sectional view showing another example of a prior art photoreceptor unit.
Figure 11:
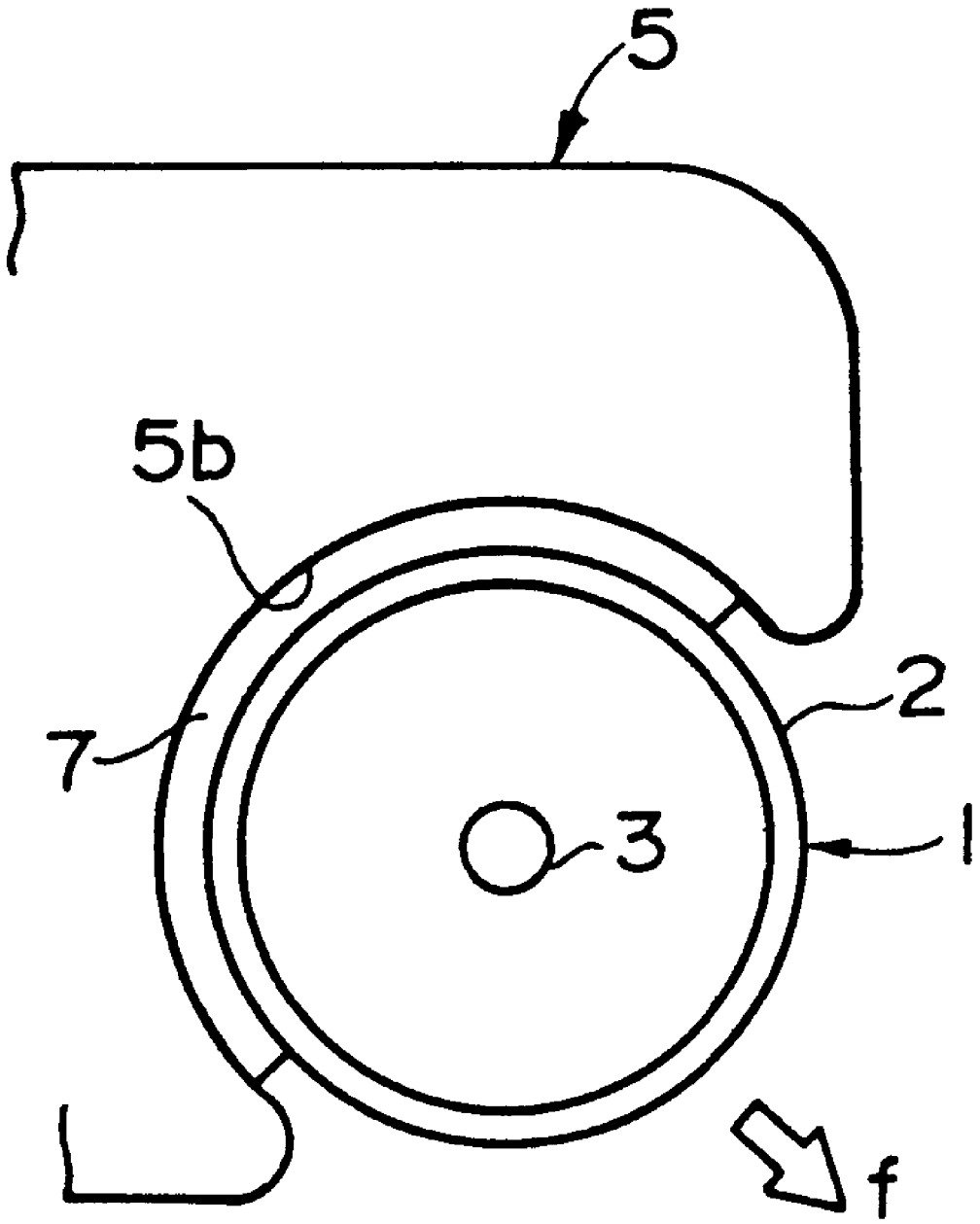
Fig.11 PRIOR ART
FIG. 11 is a sectional view showing yet another example of a prior art photoreceptor unit.

(Fourth Embodiment, see FIGS. 7 and 8)

According to the present photoreceptor unit, a boss portion 19*a* is formed on the support shaft 19, and a ring-shaped braking member 24 is mounted in a compressed state between the outer peripheral surface of this boss portion 19*a* and the inner peripheral surface of the recess portion 17*b* of the flange 17. The other construction is similar to that of the aforementioned first embodiment. The braking member 24 is stuck to the boss portion 19*a* or the flange 17 by its inner peripheral surface or outer peripheral surface. That is, the braking member 24 is mounted in the recess portion 17*b* in a state in which it is compressed throughout the entire circumference in the radial direction of the photoreceptor drum 15 similar to the aforementioned first embodiment so as to effect a load between the photoreceptor drum 15 and the support shaft 19. The effect of the load is similar to that of the aforementioned first embodiment.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

For example, the braking member may be provided not only on the flange 17 side connected to the drive gear but also on the flange 18 side.

What is claimed is:

1. A photoreceptor unit comprising:

a photoreceptor drum;

a support shaft for rotatably supporting the photoreceptor drum; and a braking member for effecting a load in a radial direction throughout the entire circumference of rotation of the photoreceptor drum, wherein said photoreceptor drum is provided with a hollow cylindrical base body and first and second flanges provided on both sides of the base body, at least one of the first and second flanges having a cylindrical recess portion recessed in an axial direction of the photoreceptor drum throughout the entire circumference of the support shaft, and said braking member is a ring-shaped member arranged in the recess portion as fixed to either an inner peripheral surface of the recess portion or the support shaft and pressed against the other.

2. The photoreceptor unit as claimed in claim 1, wherein said braking member is compressed in the radial direction throughout the entire circumference of rotation of the photoreceptor drum.

3. The photoreceptor unit as claimed in claim 1, wherein said support shaft comprises a first support shaft for the first flange and a second support shaft for the second flange, the first support shaft and the second support shaft separating from each other.

4. The photoreceptor unit as claimed in claim 1, wherein said braking member is made of a material of nitrile rubber.

5. A breaking member used in a photoreceptor unit provided with a photoreceptor drum and a support shaft for rotatably supporting the photoreceptor drum, said braking member effecting a load in a radial direction throughout the entire circumference of rotation of the photoreceptor drum, wherein said photoreceptor drum is provided with a hollow cylindrical base body and first and second flanges provided on both sides of the base body, at least one of the first and second flanges having a cylindrical recess portion recessed in an axial direction of the photoreceptor drum throughout the entire circumference of the support shaft, and said braking member is a ring-shaped member arranged in the recess portion as fixed to either an inner peripheral surface of the recess portion or the support shaft and pressed against the other.

6. The braking member as claimed in claim 5, wherein said braking member is compressed in the radial direction throughout the entire circumference of rotation of the photoreceptor drum.

7. The braking member as claimed in claim 5, wherein said support shaft comprises a first support shaft for the first flange and a second support shaft for the second flange, the first support shaft and the second support shaft separating from each other.

8. The braking member as claimed in claim 5, wherein said braking member is made of a material of nitrile rubber.

* * * * *